US011124409B2

(12) United States Patent
Carder

(10) Patent No.: US 11,124,409 B2
(45) Date of Patent: Sep. 21, 2021

(54) HIGH PRESSURE FUEL NOZZLE

(71) Applicant: Randall A. Carder, DeSoto, MO (US)

(72) Inventor: Randall A. Carder, DeSoto, MO (US)

(73) Assignee: M. CARDER INDUSTRIES, INC., Fenton, MO (US)

( * ) Notice: Subject to any disclaimer, the term of this patent is extended or adjusted under 35 U.S.C. 154(b) by 74 days.

(21) Appl. No.: 16/671,588

(22) Filed: Nov. 1, 2019

(65) Prior Publication Data

US 2020/0140257 A1 May 7, 2020

Related U.S. Application Data

(60) Provisional application No. 62/754,405, filed on Nov. 1, 2018.

(51) Int. Cl.

| | |
|---|---|
| ***B67D 7/48*** | (2010.01) |
| ***B67D 7/54*** | (2010.01) |
| ***B67D 7/52*** | (2010.01) |

(52) U.S. Cl.

CPC ..... *B67D 7/48* (2013.01); *B67D 7/52* (2013.01); *B67D 7/54* (2013.01)

(58) Field of Classification Search

CPC ..... B67D 7/48; B67D 7/54; B67D 7/52

USPC ..... 141/206, 59, 214, 215

See application file for complete search history.

(56) References Cited

U.S. PATENT DOCUMENTS

| | | | | |
|---|---|---|---|---|
| 2,111,852 A * | 3/1938 | Flinchbaugh | ..... | B67D 7/48 141/215 |
| 2,445,524 A * | 7/1948 | Grise | ..... | B67D 7/48 141/214 |
| 2,529,936 A * | 11/1950 | Grise | ..... | B67D 7/48 141/214 |
| 2,795,391 A * | 6/1957 | Krone | ..... | B67D 7/52 251/38 |

(Continued)

FOREIGN PATENT DOCUMENTS

KR 1020110136239 A 12/2011

OTHER PUBLICATIONS

International Search Report of the corresponding PCT Application No. PCT/US2019/059476 dated Feb. 25, 2020.

(Continued)

*Primary Examiner* — Timothy L Maust
*Assistant Examiner* — James R Hakomaki
(74) *Attorney, Agent, or Firm* — Churovich Law, LLC; Douglas D. Churovich

(57) ABSTRACT

An automatic shut-off fluid nozzle having a primary fluid path, a vacuum-actuated fluid shut-off assembly in the fluid path, said shut-off shutting off flow through the fluid path when the pressure chamber is subjected to a predetermined vacuum. The nozzle having a venturi port in said fluid path and connected to a vacuum channel, and a vacuum vent extending away from the vacuum channel, said vacuum vent communicating with a low vacuum environment. The nozzle further having a segregated fluid channel in the primary fluid path, the venturi port communicating with said segregated (Continued)

fluid channel, such that the flow of fluid past the venturi port creates a venturi vacuum in the vacuum channel. The vacuum exhausts the vacuum through the vent port when the vent port is in an open condition, and creates a vacuum in the vacuum-actuated fluid shut-off assembly when said vent port is in a closed condition.

23 Claims, 3 Drawing Sheets

(56) References Cited

U.S. PATENT DOCUMENTS 2,869,584 A * 1/1959 Gordon ..... B67D 7/48 137/630
3,757,834 A * 9/1973 Carder ..... B67D 7/48 141/225
4,139,031 A * 2/1979 Wood ..... B67D 7/54 141/206
4,203,478 A * 5/1980 Saito ..... B67D 7/48 141/206
4,214,614 A * 7/1980 Pyle ..... B67D 7/421 137/614
4,245,681 A * 1/1981 Guertin ..... B67D 7/52 141/206
4,351,375 A 9/1982 Polson
4,453,578 A 6/1984 Wilder
4,572,255 A * 2/1986 Rabinovich ..... B67D 7/48 137/463
4,913,200 A * 4/1990 Carow ..... B67D 7/48 137/463
5,363,889 A * 11/1994 Simpson ..... B67D 7/46 141/208
5,390,712 A * 2/1995 Parrish ..... B67D 7/38 141/206
5,417,259 A * 5/1995 Schneider ..... B67D 7/048 141/206
5,469,900 A * 11/1995 Weeks ..... B67D 7/50 141/206
5,967,385 A 10/1999 Coates, III
6,024,140 A 2/2000 Garrison et al.
7,255,140 B2 * 8/2007 Poli ..... B67D 7/50 141/206
8,371,341 B2 * 2/2013 Gray ..... B67D 7/048 141/59

OTHER PUBLICATIONS

Written Opinion of the corresponding PCT Application No. PCT/US2019/059476 dated Feb. 25, 2020.

* cited by examiner

HIGH PRESSURE FUEL NOZZLE

CROSS REFERENCE TO RELATED APPLICATIONS

This application derives and claims priority from U.S. provisional application 62/754,405 filed Nov. 1, 2018, which U.S. provisional application is incorporated herein by reference.

STATEMENT REGARDING FEDERALLY SPONSORED RESEARCH OR DEVELOPMENT

Not applicable.

BACKGROUND OF THE INVENTION

This invention relates to a dispensing nozzle of the type used for dispensing liquid fuels such as gasoline and the like from large holding tanks into fuel tanks for vehicles and other such applications. More particularly, this invention is directed to a compact, relatively inexpensive, and durable dispensing nozzle having an improved mechanism for accommodating the dispensing of such fuels at elevated pressures so as to reduce the period of time required for fueling.

Fluid dispensing nozzles, and in particular nozzles for dispensing fuels such as gasoline, aviation fuel or oils, conventionally include a body or casing having an inlet and an outlet, an outlet spout assembly, a poppet valve for controlling flow between the inlet and outlet spout assembly, and an automatic diaphragm shut-off assembly. Typically, a spring is used to urge the poppet downward against a seat inside the body. A valve stem, which is operated by a manually operated lever or handle, opens the poppet valve against the force of the spring. The plunger of an automatic shut-off assembly forms a pivot for the lever at the forward end of the lever.

The lever is typically S-shaped, and includes a forward arm pivotally attached to the plunger of the automatic shut-off device and also engaging the valve stem of the poppet valve, an intermediate portion, and a rearward handhold.

In a typical construction, fluid flows around a check valve attached to a spout adapter upstream of the spout, and then past four radial bores in the spout adapter. The fluid flow past the four radial bores creates a venturi vacuum in the bores. Small channels in the nozzle connect the radial bores in the spout adapter to the nozzle's diaphragm assembly, while a spout vent open to atmosphere and communicating with the spout adapter simultaneously limits the strength of the vacuum that is drawn on the diaphragm. The venturi vacuum created in the spout adaptor communicates with the diaphragm to control the operation of the diaphragm. That is, when the vacuum created by the venturi reaches a predetermined strength, the diaphragm will trigger and shut off the flow of fluid through the nozzle. However, so long as the spout vent is open to atmosphere so as to maintain the vacuum at a level that is weaker than what is required to trigger the diaphragm, the diaphragm will remain open and allow the flow of fluid through the nozzle and out the spout. Consequently, when the venturi no longer can exhaust itself through the spout vent, such as for example, when the fluid tank being filled by the nozzle is full and fluid fills the spout vent, the diaphragm is then subjected to a stronger vacuum and triggers to shut off the flow of fluid to the spout. Thus, this venturi creates a vacuum in the shut-off assembly that triggers the shut-off valve and stops the flow of fluid through the nozzle when, for example, the spout vent fills with fluid.

This configuration works well for traditional low and moderate pressure circumstances (i.e., below approximately 50 p.s.i.). However, when such traditional nozzles are subjected to high pressure conditions in the spout (i.e., greater than approximately 50 p.s.i., and certainly in the 100 p.s.i. range), the fluid can back up into the spout even when the tank being supplied with fluid has not yet filled. When this happens, the fluid backing into the spout overwhelms the four radial bores in the spout assembly and shuts down the venturi vacuum. This prevents the diaphragm in the diaphragm assembly from shutting off the flow of fluid through the nozzle to the spout.

A need therefore exists for a nozzle configuration that accommodates high pressure conditions through the nozzle's spout without suffering from premature shut-off of or failure to shut-off the fluid flow due to inadvertent disablement of the venturi vacuum in the spout adaptor region of the nozzle.

BRIEF DESCRIPTION OF THE SEVERAL VIEWS OF THE DRAWINGS

The illustrative embodiments of the present invention are shown in the following drawings which form a part of the specification.

Corresponding reference numerals indicate corresponding parts throughout the several figures of the drawings.

DETAILED DESCRIPTION OF THE INVENTION

Figure 1:
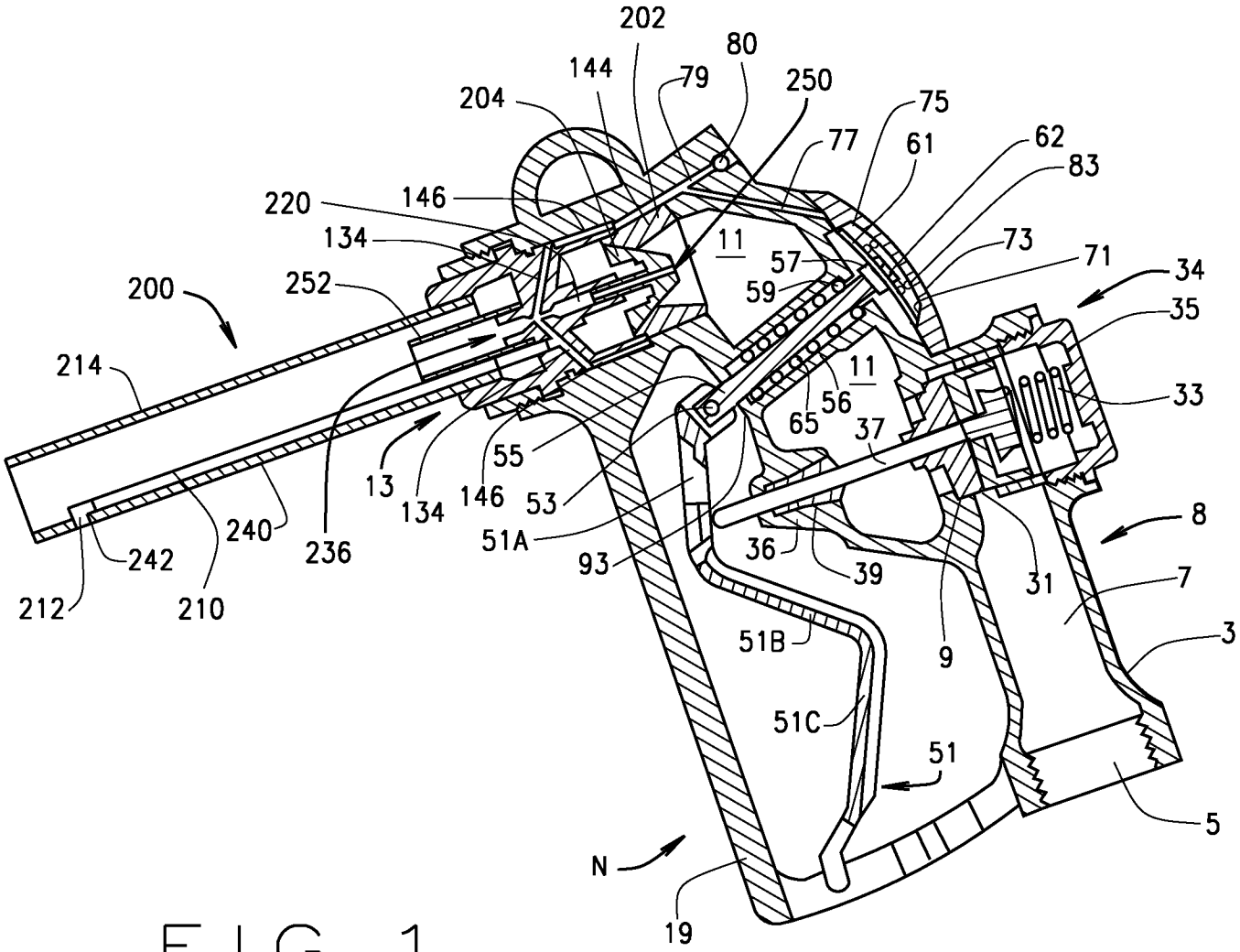
FIG. 1 is a cross-sectional view in side elevation of an illustrative nozzle having a traditional nozzle assembly attached to a high pressure spout adapter in accordance with one embodiment of the present invention.

While the invention will be described and disclosed here in connection with certain preferred embodiments and its best mode, the description is not intended to limit the invention to the specific embodiments shown and described herein. Rather, the invention is intended to cover all alternative embodiments and modifications that fall within the spirit and scope of the invention as defined by the claims included herein as well as any equivalents of the disclosed and claimed invention.

In referring to the drawings, a first representative embodiment 10 of the novel high pressure spout assembly of the present invention is shown generally in FIGS. 1 and 3-5, where the present invention is depicted by way of example, both independently and in association with a representative fluid nozzle N. The basic operational details of the nozzle N are well known and do not, per se, form a part of the present invention.

Briefly, the nozzle N includes a cast body 3, preferably formed of aluminum. The body 3 includes a fluid passage (or fluid flow path) including an inlet 5, a generally cylindrical inlet chamber 7 that extends into the body 3 from the inlet 5, a valve seat 9, an outlet chamber 11 downstream of the valve seat 9, and an outlet 13 that is open to the chamber 11. Inlet 5 is threaded to receive a flexible hose from a gasoline pump (not shown). The portion of the body 3 forming the inlet chamber 7 also forms a hand-hold 8 for the nozzle N. A hand guard 19 forms part of the body 3.

Most of the inner parts of the nozzle N are standard. A main poppet valve assembly 31 is urged by a poppet spring 33 against the valve seat 9 to controllably close the passage of fluid from the inlet 5 through the body 3 to the outlet 13. The poppet spring 33 is held in a casing cap 35 threaded into an opening 34 in the top of the body 3 atop the poppet valve assembly 31. A stem 37 extending from the lower end of the valve assembly 31 downward into the body 3 is slidably mounted in a cast bracket 36 in the body 3. The lower portion of the stem 37 passes through a sliding seal 39 positioned in the bracket 36 of the body 3.

A standard lever 51 is provided for manually engaging the valve stem 37 and lifting the valve assembly 31 toward the cap 35 and away from the valve seat 9. The lever 51 is S-shaped, with a generally horizontal lower lever portion 51A, an intermediate portion 51B, and an upper grip portion 51C.

The lower lever portion 51A of the lever 51 is held by a pivot pin 53 to the lower end of a cylindrical plunger 55 which is mounted for reciprocation in an axial bore 56 in the body 3 as described in more detail hereinafter. The plunger 55 forms a part of an automatic shut-off system for shutting off the flow of fluid through the nozzle N when the fluid backflows into the nozzle N. The shut-off system includes above the plunger 55, a latch pin (not shown), a diaphragm head 57, a set of balls bearings 59, and rubber diaphragm 61, and a diaphragm retainer 62. The latch pin 57 extends into blind cross-bores in the upper end of the plunger 55 and the diaphragm head 57, to hold the two together. A coil plunger spring 65 presses against the underside of the diaphragm head 57 and thereby biases the plunger 55 upward. Three radial openings extending from the outer surface of the cylindrical plunger 55 into the axial bore 56 act as guide-ways for the latching balls 59. The upper end of the latch head 57 is secured to the center of the diaphragm 61, which is held in place by a diaphragm retainer 62 positioned atop of the diaphragm 61. The periphery of the diaphragm 61 is secured to a shoulder 71 of the body 3 by a vacuum cap 73 and defines with the vacuum cap 73 a pressure chamber 75 in the body 3. A vacuum slot or channel 77 extends from the pressure chamber 75 to a second vacuum slot or channel 79 in the body 3 near the outlet 13. The pressure channels 77 and 79 skirt the outlet chamber 11. A balance spring 83 located on the upper side of the diaphragm 61 determines the sensitivity of the automatic shut-off system. That is, the balance spring 83 determines the vacuum level in the pressure chamber 75 that must be achieved in order to activate the diaphragm 61 and shut off flow through the nozzle N, as can readily be understood.

The portion of the body 3 forming the housing for the shut-off system includes the cylindrical bore 56, which forms a housing for the plunger 55. The inner surface of the cylindrical bore 56 is stepped to form a balance chamber, a chamber for the balls 59, and a chamber for spring 65. A circular orifice 93 at the bottom of cylindrical bore 56 acts as a guide for plunger 55 where it exits the cast body 3 and as a bearing for plunger return spring 65.

As described thus far, the nozzle N is conventional. Secured in the nozzle N through the outlet 13 and opposite the inlet 5 is a spout assembly. What is shown in FIG. 1 is a novel configuration for a representative spout assembly 200 that incorporates novel features of the present disclosure. A representative traditional spout assembly 100 is depicted in FIG. 2, which will be described for comparative purposes.

Figure 2:
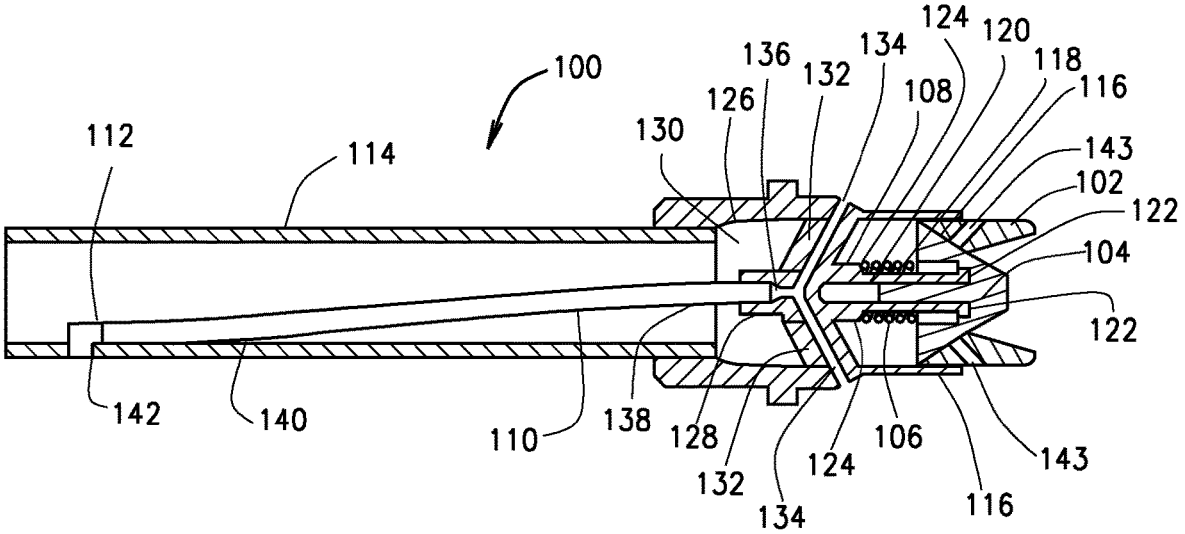
FIG. 2 (PRIOR ART)
FIG. 2 is a cross-sectional view in side elevation of a representative traditional spout adapter for a traditional nozzle, such as the nozzle of FIG. 1.
Figure 3:
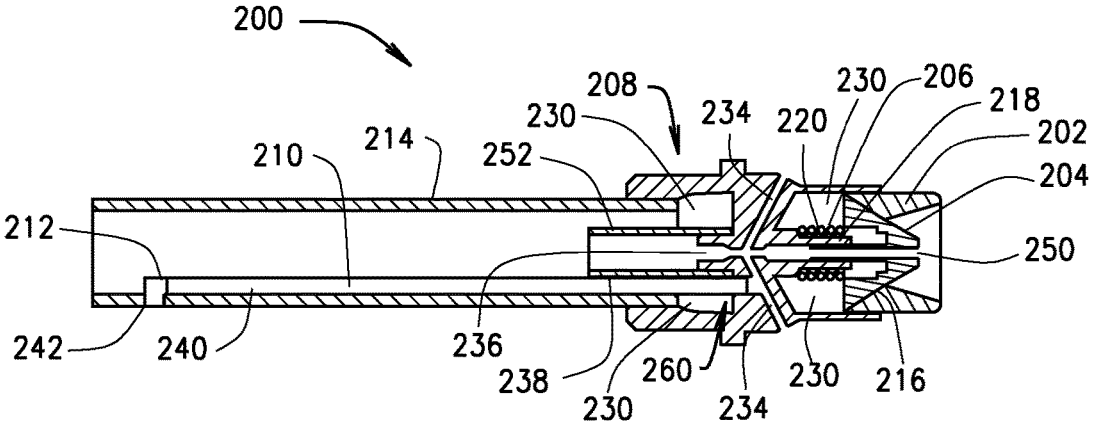
FIG. 3 is a cross-sectional view in side elevation of the spout, spout adapter, and related components of the nozzle of FIG. 1.
Figure 4:
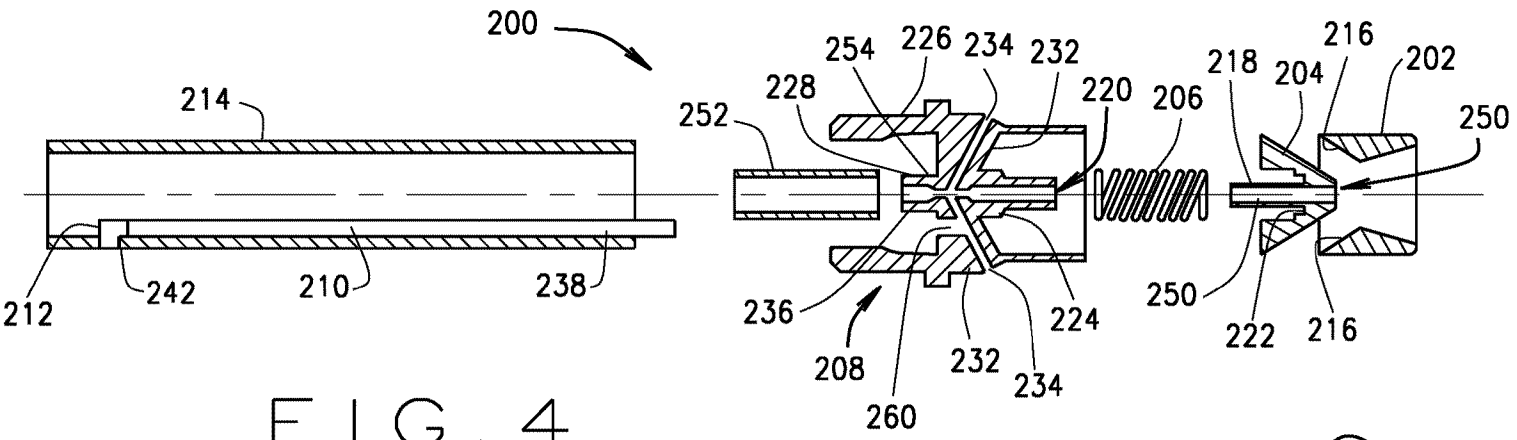
FIG. 4 is an exploded view of FIG. 3.
Figure 5:
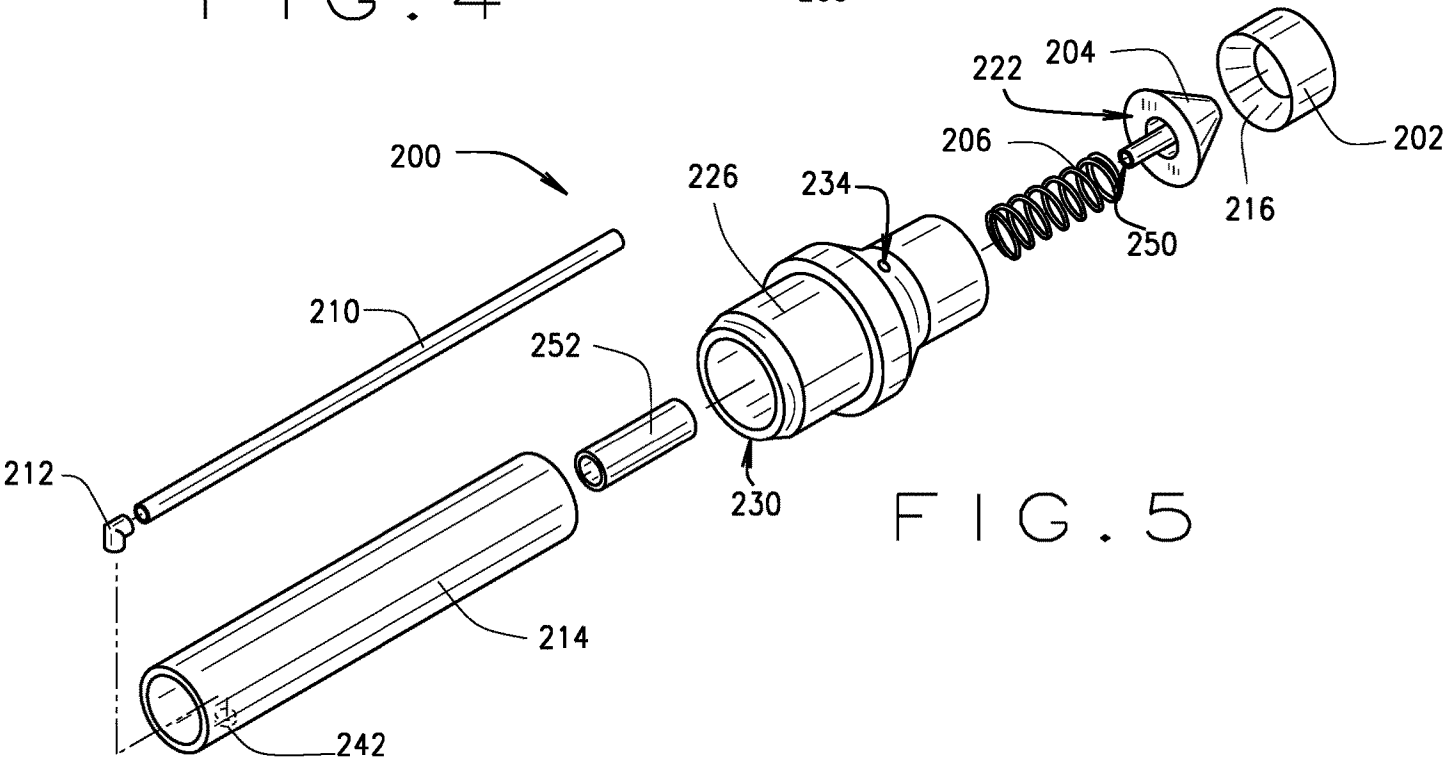
FIG. 5 is a perspective view of the spout, spout adapter, and related components of FIG. 3.

Referring to FIG. 2, the representative traditional spout assembly 100 comprises a bleeder seat 102, a conical check valve piston or poppet 104, a check valve spring 106, a spout adapter 108, a bleeder or vent tube 110 with a port adaptor 112, and a spout 114. As can be seen, the conical walls of the check valve poppet 104 seat against matching conical walls 116 on the inner surface of the bleeder seat 102. An axial shaft 118, extending downward from the center of the base of the check valve poppet 104 is slidably positioned within a central axial bore 120 in the spout adapter 108. The valve spring 106 is positioned axially about the shaft 118 and is compressed between a neck 122 within the body of the check valve poppet 104 at one end and a ledge or lip 124 along the outer surface of the spout adapter 108. It will be understood that the configuration specifications of the spring 106, and the distance between the neck 122 and lip 124 determine the pressure necessary to overcome the spring load on the check valve poppet 104.

The spout adapter 108 has a generally cylindrical outer body 126 surrounding a generally cylindrical central body 128 that together form a fluid flow channel 130 there between. A set of two arms 132 extend radially and at a slight angle rearward from the central body 128 to the outer body 126. A set of two through bores 134 extend through the center of each of the arms 132 and join together and open into an axial bore 136 in the central body 128 coaxial with and extending from the axial bore 120. A proximal end 138 of the vent tube 110 is secured in the axial bore 136, while the distal end 140 of the vent tube 110 attaches to the port adaptor 112 which is secured to an opening 142 in the side of the spout 114. Further, a set of four equally-spaced radial bores 143 extend through the bleeder seat 102, each initiating on the outer cylindrical surface of the bleeder seat 102 and terminating adjacent the check valve poppet 104, such that the check valve poppet 104 closes the bores 143 when the check valve poppet 104 rests against the bleeder seat 102.

When a spout assembly is properly positioned in the outlet 13 of the nozzle N (such as for example as the spout 200 is secured in the nozzle N in FIG. 1), the cylindrical outer surface of the bleeder seat 102 secures against, and forms a fluid seal against, a matching inner cylindrical mating surface 144 formed in the outlet chamber 11. As can be seen and appreciated, a cylindrical gap 146 is thereby created between the inner surface of outer body 126 and the outer surface of the central body 128. This gap 146 extends from the open end of the channel 79 in mating surface 144, where the outer ends of each of the four bores 143 open into the gap 146, to the outer open ends of the through bores 134. Of course, the channel 79 opens into the channel 77, which in turn opens into the pressure chamber 75 of the diaphragm assembly. This provides a contiguous open pathway or fluid flow path joining the axial bore 136, the radial bores 143, and the pressure chamber 75 in the diaphragm assembly of the nozzle N.

As one of skill in the art will understand, as fluid flows from the inlet 5 through the inlet chamber 7, through the outlet chamber 11, it encounters the check valve poppet 104. If provided sufficient pressure from the fluid flow, the valve spring 106 will be overcome, and the check valve poppet 104 will be forced open. The fluid will then flow around the perimeter of the check valve poppet 104, through the flow channel 130 in the middle of the spout adapter 108, past the arms 132, around the center body 128, around the vent tube 110 and through the spout 114. As the fluid flows over and past the open inner ends of the four radial bores 143 in the bleeder seat 102 surrounding the check valve poppet 104, a venturi is created in the radial bores 143 which creates a vacuum in the cylindrical gap 146. This venturi creates a vacuum draw through the channels 79 and 77, which generates a vacuum in the pressure chamber 75 above the diaphragm 61. However, the venturi simultaneously draws air from the vent tube 110 through the bore 126 and the bores 134, which thereby effectively reduces the vacuum delivered to the diaphragm 61 and precludes the creation of a sufficiently strong vacuum in the pressure chamber 75 to activate the diaphragm 61. However, when the air supply through the vent tube 110 is shut off or substantially reduced, the vacuum created by the venturi in the cylindrical gap 146 is no longer relieved to atmosphere, and instead travels through the channel 79, through the channel 77, to in turn create a greater vacuum in the pressure chamber 75. As can be appreciated, the characteristics of the spring 65, which holds the diaphragm 61 in tension, are specifically chosen to provide sufficient bias to the diaphragm 61 to prevent premature release of the automatic shut-off while at the same time allowing the vacuum created by the venturi to raise the diaphragm 61 to activate the shut-off when venturi cannot draw on atmosphere.

Unfortunately, it has been found that when the fluid flowing through nozzle N, having a traditional spout assembly, such as the spout assembly 100, is subjected to a high pressure (e.g., greater than 50 p.s.i.), the traditional nozzle N is subject to malfunction in one of two ways depending upon the particular conditions in the spout assembly 100. Either the fluid will be forced up through the radial bores 143 and into the cylindrical gap 146, disabling the venturi, which thereby precludes the creation of an adequate vacuum in the pressure chamber 75 to activate the diaphragm 61 and shut off flow through the nozzle N upon a shut-off condition; or the venturi created by the fluid flow past the radial bores 143 will generate a vacuum that is too strong for the air flow from the vent tube 110 to overcome, such that the diaphragm 61 will activate and shut off fluid flow in the nozzle N prematurely. The novel spout assembly, shown by way of example at 200, overcomes these shortcomings.

Referring to FIGS. 1 and 3-5, it can be seen that the spout assembly 200 shares many components similar to the spout assembly 100, including a bleeder seat 202, a conical check valve piston or poppet 204, a check valve spring 206, a spout adapter 208, a bleeder or vent tube 210 with a port adaptor 212, and a spout 214. The vent tube 210 has a proximal end 238 and a distal end 240. As can be seen, the conical walls of the check valve poppet 204 seat against matching conical walls or valve surfaces 216 on the inner surface of the bleeder seat 202. An axial shaft 218, extending outward from the center of the check valve poppet 204 is slidably positioned within a central axial bore 220 in the spout adapter 208. The valve spring 206 is positioned axially about the shaft 218 and is compressed between a neck 222 within the check valve poppet 204 at one end and a ledge or lip 224 along the outer surface of the spout adapter 208. It will be understood that the configuration specifications of the spring 214, and the distance between the neck 222 and lip 224 determine the pressure necessary to overcome the spring load or bias placed on the check valve poppet 204 by the spring 214.

The spout adapter 208 has a generally cylindrical outer body 226 surrounding a generally cylindrical central body 228 that forms a fluid flow channel 230 there between. A set of two arms 232 extend radially outward from the central body 228 to the outer body 226 at a slight angle directed toward the check valve poppet 204. A set of two through bores 234 extend through the center of each of the arms 232 and join together and open at their inner ends into an axial bore 236 in the central body 228 that is coaxial with and adjoining the axial bore 220. That is, in contrast to the traditional spout adapter 108, in which the axial bores 120 and 136 do not join (see FIG. 2), the axial bores 220 and 236 form a contiguous axial bore through the center of the spout adapter 208.

As in the traditional spout adapter 108, the distal end 240 of the vent tube 210 attaches to the port adaptor 212 which is attached to an opening 242 in the side of the spout 214. However, the proximal end 238 of the vent tube 210 is secured in a bore 260, located in the side of one of the radial arms 232. The bore 260 extends from the flow channel 230 into the radial bore 234 of the radial arm 232 comprising the bore 260. Further, in contrast to the bleeder seat 102 of the traditional spout adapter 100, the bleeder seat 202 lacks the set of four equally-spaced radial bores 143 that extend through the bleeder seat 102. Rather, the check valve poppet 204 comprises an axial through bore 250 that allows fluid from the chamber 11 to flow through the center of the check valve poppet 204, through the axial bores 220 and 236 in the central body of the spout adapter 208, through a rigid plastic back-pressure tube 252 having a length of approximately two inches, which is attached snugly over a short nipple 254 surrounding the axial bore 236, and into the spout 214.

As one of skill in the art will understand, as fluid flows from the inlet 5 through the inlet chamber 7, through the outlet chamber 11, it encounters the check valve poppet 204. If provided sufficient pressure from the flow, the valve spring 206 will be overcome, and the check valve poppet 204 will be forced open. Most of the fluid will then flow around the perimeter of the check valve poppet 204, while a small portion of the fluid will be diverted to flow through the axial bore 250 in the center of the check valve poppet 204. The greater volume of fluid passing around the check valve poppet 204 will flow through flow channel 230 in the middle of the spout adapter 208, past the arms 232, around the center body 228, over the vent tube 210 and through the spout 214.

The smaller fluid flow entering the axial bore 250 will instead flow through the contiguous axial bores 220 and 236 in the central body 228 of the spout adapter 208, such that the flow will pass over the open inner ends of the two through bores 234 and create a venturi effect that generates a vacuum in the bores 234. Because the bores 234 are open to the cylindrical gap 146, this vacuum draws through the cylindrical gap 146, through the channels 79 and 77, which in turn generates a vacuum in the pressure chamber 75 above the diaphragm 61. However, because the bore 260 opens into one of the bores 234 and the bore 260 is open to atmosphere through the vent tube 210, the venturi vacuum simultaneously draws air from the atmosphere, which thereby effectively reduces the vacuum delivered to the diaphragm 61 and precludes the creation of a sufficiently strong vacuum in the pressure chamber 75 to activate the diaphragm 61. However, when the air supply through the vent tube 210 is shut off or substantially reduced, the vacuum created by the venturi in the bores 234 is no longer relieved to atmosphere, and instead travels through the cylindrical gap 146, through the channel 79, through the channel 77, to in turn create a greater vacuum in the pressure chamber 75. As can be appreciated, the characteristics of the spring 65, which holds the diaphragm 61 in tension, are specifically chosen to provide sufficient bias to the diaphragm 61 to prevent premature release of the automatic shut-off while at the same time allowing the vacuum created by the venturi to raise the diaphragm 61 to activate the shut-off when venturi cannot draw on atmosphere.

As fluid flows from the inlet 5 through the inlet chamber 7, through the outlet chamber 11, it encounters the check valve poppet 204. If provided sufficient pressure (e.g., greater than 50 p.s.i.), the force of the valve spring 206 will be overcome, and the check valve poppet 204 will be forced open. For very brief instance, the fluid will flow through the bore 250 in the center of the check valve poppet 204, but once the valve spring 206 is overcome, the fluid will also flow around the perimeter of the check valve poppet 204, through the flow channel 230 in the middle of the spout adapter 208, around the vent tube 210 and through the spout 114. As the fluid flows past through the bore 250 in check valve poppet 104, a venturi is created in the radial bores 234 in the spout adapter 208, which creates a vacuum in the cylindrical gap 146.

This vacuum draws air from the bleeder tube 210 through the bore 260, which precludes the creation of a strong vacuum in the pressure chamber 75. However, when the air supply through the bleeder tube 210 is shut off or substantially reduced, the vacuum created by the venturi in the cylindrical gap 146 travels through the channel 79, through the channel 77, and in turn creates a greater vacuum in the pressure chamber 75. This vacuum overpowers the spring 214, thereby activating the diaphragm 61 to shut off flow through the nozzle N.

As can be appreciated from the present disclosure, the placement of the venturi in the center of the spout adapter 208 limits the amount of fluid in the vicinity of the venturi and precludes excess high pressure fluid from clogging, backing up, or otherwise interfering with the proper operation of the venturi. The presence of the back-pressure tube 252 further enhances this protective configuration to prevent excess fluid flowing rapidly through the flow channel 230 from backing up into the axial bore 236 and interfering with the venturi.

It should be noted that while the present invention was created to solve a problem identified when fluid being passed through a traditional nozzle was subjected to pressures higher than traditionally used in the industry (i.e., greater than approximately 50 p.s.i.), the present invention can readily be incorporated into and properly operate in nozzles using lower, traditional fluid pressures (i.e., 50 p.s.i. or less). In such circumstances, the novel high pressure spout assembly provides similar benefits over traditional nozzles. That is, even at lower fluid pressures, traditional nozzles are known to periodically malfunction due to defective operation of the venturi. The present invention provides improvements over such traditional nozzles, even when operating at standard lower fluid pressures.

While I have described in the detailed description configurations that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel mechanisms of the present invention, shown by way of example at 200 can be arranged in a number of other and related varieties of configurations without departing from or expanding beyond the scope of my invention as set forth in the claims.

For example, while the most restrictive diameter of the fluid flow bores 220 and 236 through the check valve poppet 204 are designed to accommodate a range of anticipated high fluid pressure flows, it is fully contemplated that each of those diameters may be modified for particular applications. That is, for example, the bores 220 and/or 236 can be shaped and sized to "tune" the flow through check valve poppet 204 to a desired or particular fluid pressure or fluid pressure range. Similarly, the bores 234 and their inner openings can be likewise modified for particular applications to adjust or control the anticipated vacuum from the venturi as the fluid flows past those bore ends. Thus, directed regulation of the venturi operation can be achieved by simply resizing and/or reshaping the bores 220 and/or 236 and/or 234 to specified tolerances for specific fluid pressure applications. It is contemplated that a series of check valve poppets 204, with varying yet specified bore sizings, can be produced to offer flexibility in use of a single spout assembly 200 and associated nozzle N, by allowing the user to exchange the check valve poppet 204 with differing bore shapes and/or sizes, each such bore having distinct fluid flow dynamics and characteristics, to suit differing fluids and fluid flow pressure needs.

Further, while each of the bores, tubes and channels (such as for example bores 220 and 236, tubes 210 and 252, and channels 77 and 79) in the spout assembly 200 have a particular length, are generally straight, and are generally constructed or formed with circular and/or cylindrical sidewalls for purposes of manufacture, none are limited to being straight, or to such specific lengths or cross-sectional shapes, but each such bore, tube and channel may instead be constructed with various curves, lengths, and various cross-sectional shapes (such as for example ovals, squares, rectangles, etc.), so long as shape of the bore, tube or channel does not hinder the operation of the spout assembly 200 as described herein.

In addition, it is not necessary that the openings that create the venturi vacuum in the spout assembly 200 be positioned exactly as shown in the figures. Rather, the venturi may be moved upstream or downstream in the fluid flow path so long as the full flow is segregated such that a small portion of the flow is used to generate the venture.

The spout assembly 200 depicts a preferred configuration for diverting a portion of the overall nozzle N fluid flow to create a segregated venturi vacuum that controls the shut-off assembly in the nozzle N. This diversion of a portion of the overall fluid flow is one aspect of the unique nature of the present invention. Of course, other configurations that likewise divert a portion of the overall nozzle N fluid flow are contemplated by this disclosure. For example, a slot could be cut or a small open tube placed along the inner surface of the body 3 proximate to and opening into the channel 79, such that the slot or tube would limit the amount of fluid passing over the opening to the channel 79 and thereby control the venturi thus created. Alternately, a channel or flow path for a portion of the overall nozzle N fluid flow can be created in the body 3 or outside the body 3 that bypasses the check valve poppet 104 or 204 where the segregated portion of the fluid flow rejoins the overall flow downstream of the check valve poppet. Of course, any such alternate segregated fluid flow path will need to: (i) be open to the flow path(s) (e.g., the channels 77 and 79) that lead to and open into the diaphragm chamber 75; and (ii) open to a controllable pressure release device (such as the vent tube 110 or 210) that provides a release for the venturi vacuum until a desired condition occurs, such as for example the closing of the vent tube (110 or 210) that causes the venturi vacuum to draw down the air in the chamber 75 to activate the diaphragm 61 that in turn shuts off flow through the nozzle N.

Of course, one of ordinary skill in the art will recognize that manufacture concerns often dictate the parsing of various elements or components of a particular embodiment. That is, for example, various of the components of the novel nozzle N and spout assembly 200, though depicted and described as separate or individual elements, can be manufactured together without departing from the invention disclosed herein. For example, the back pressure tube 252 can be constructed as part of, i.e., as an extension of, the nipple 254. Similarly, the central body 228, though depicted as a single cast and machined part, can be produced in a number of parts that would then be attached to one another to construct the complete central body 228.

The vent tube 210 need not open into or intersect the bore 234 in the particular location depicted. In fact, the vent tube 210 need not open into or intersect the bore 234. Rather, all that is needed for the spout assembly 200 to operate properly is for the vent tube 210 to open into or intersect one or more of the bores and channels that form the venturi vacuum channel that connect with and opens into the chamber 75. Similarly, the vent tube 210 can be of varying length and girth, so long as the tube is capable of venting sufficient of the venturi vacuum to atmosphere to disable to preclude the activation of the diaphragm 61. The vent tube 210 need not be positioned in specific position along the spout 214 as shown, but can instead be configured and positioned to exit the spout assembly 200 at nearly any position along the spout 214.

Although coil springs, such as the springs 106 and 206, are depicted as devices that apply bias to various components, various other types of springs and other biasing devices can be used in place of the coil springs so long as they can function properly in the nozzle N environment and perform the function of the spring being replaced.

Additional variations or modifications to the configuration of the novel fluid nozzle and spout assembly of the present invention, shown by way of example at 10, may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention. Accordingly, all matter contained in the above description or shown in the accompanying drawings should be interpreted as illustrative and not in a limiting sense.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

The invention claimed is:

1. A spout adapter for attachment to a high pressure automatic shut-off nozzle assembly, the nozzle assembly having a first vacuum flow path, the nozzle assembly having a vacuum-actuated automatic fluid flow shut-off assembly in communication with said first vacuum flow path and adapted to selectively stop fluid flow through a first fluid path in the nozzle assembly when the shut-off assembly is subjected to a predetermined vacuum in said first vacuum flow path, the spout adapter comprising:

a. a hollow outer body, said outer body defining a second fluid path through said spout adapter, said second fluid path communicating with said first fluid path in the nozzle assembly when the spout adapter is mated to the nozzle assembly;

b. a first poppet valve positioned in said second fluid path;

c. a first vacuum channel comprising a Venturi port, said first vacuum channel communicating with said first vacuum flow path in the nozzle assembly when the spout adapter is mated to the nozzle assembly;

d. a vacuum vent positioned at least in part inside said outer body, said vacuum vent communicating with and extending from said first vacuum channel, said vacuum vent having an open condition and a closed condition, said vacuum vent communicating with a low vacuum environment when in said open condition, said low vacuum environment being incapable of actuating the vacuum-actuated automatic fluid flow shut-off assembly in the nozzle when the spout adapter is mated to the nozzle assembly; and e. a segregated fluid channel having an inlet and an outlet, said inlet accepting fluid from said second fluid path into said segregated fluid channel, said outlet releasing fluid from said segregated fluid channel into said second fluid path, said segregated fluid channel having an upstream portion in proximity to said inlet and a downstream portion in proximity to said outlet, said upstream portion extending through said first poppet valve, said downstream portion being separate from said first poppet valve, said Venturi port being positioned in and communicating with said downstream portion of said segregated fluid channel, the flow of fluid past said Venturi port creating a Venturi, said Venturi creating a vacuum in said first vacuum channel, said vacuum exhausting at least in part through said vacuum vent when said vacuum vent is in its open condition, said vacuum extending into said nozzle shut-off assembly when said vacuum vent is in its closed condition and the spout adapter is mated to the nozzle assembly.

2. The spout adapter of claim 1, wherein said segregated fluid channel comprises a fluid flow limiting cross-sectional portion, said cross-sectional portion restricting the flow of fluid through said segregated fluid channel.

3. The spout adapter of claim 2, wherein said segregated fluid channel cross-sectional portion is positioned in said first poppet valve.

4. The spout adapter of claim 1, wherein said second fluid path accommodates fluid flow at a pressure greater than 50 p.s.i.

5. The spout adapter of claim 1, further comprising a central body, said central body comprising said downstream portion of said segregated flow channel.

6. The spout adapter of claim 5, wherein said Venturi port communicates with said segregated fluid channel in said central body.

7. The spout adapter of claim 5, further comprising a radial arm, said radial arm extending from said central body to said outer body, said radial arm comprising a channel there through, said first vacuum channel comprising said radial arm channel.

8. The spout adapter of claim 1, further comprising a second poppet valve, said second poppet valve being interchangeable with said first poppet valve in said spout adapter, only one of said interchangeable poppet valves being positioned in said spout adapter at any one time, each of said interchangeable poppet valves comprising said downstream portion of said segregated flow channel, said second poppet valve downstream portion being shaped and sized to allow a greater fluid flow there through than the fluid flow allowed through said first poppet valve downstream portion.

9. The spout adapter of claim 1, further comprising a hollow conduit, said conduit communicating with said outlet of said segregated fluid channel to extend at least a portion of said segregated fluid channel through said conduit.

10. The spout adapter of claim 1, further comprising a spout vent, said spout vent communicating with and extending a desired length away from said vacuum vent.

11. The fluid nozzle of claim 1, wherein said segregated fluid channel comprises at least in part a groove, a slot or a tube.

12. An automatic shut-off fluid nozzle comprising:

a. a hollow body having a fluid inlet and a fluid outlet opposite said inlet, said body defining a fluid path from said inlet through said outlet;

b. a vacuum-actuated automatic fluid flow shut-off assembly operatively associated with said fluid path, said shut-off assembly having a pressure chamber and a diaphragm, said pressure chamber and diaphragm being configured to operate together to shut off flow of fluid through said fluid path when said pressure chamber is subjected to a predetermined vacuum;

c. a first poppet valve positioned in said fluid path;

d. a first vacuum channel comprising a Venturi port, said first vacuum channel communicating with said fluid path;

e. a vacuum vent extending from said first vacuum channel, said vacuum vent having an open condition and a closed condition, said vacuum vent communicating with a low vacuum environment when in said open condition, said low vacuum environment being incapable of actuating said vacuum-actuated automatic fluid flow shut-off assembly; and f. a segregated fluid channel having an inlet and an outlet, said inlet accepting fluid from the fluid path into said segregated fluid channel, said outlet releasing fluid from said segregated fluid channel into said fluid path, said segregated fluid channel having an upstream portion in proximity to said inlet and a downstream portion in proximity to said outlet, said upstream portion extending through said first poppet valve, said downstream portion being separate from said first poppet valve, said Venturi port being positioned in and communicating with said segregated fluid channel, the flow of fluid past said Venturi port creating a Venturi, said Venturi creating a vacuum in said first vacuum channel, said vacuum exhausting at least in part through said vacuum vent when said vacuum vent is in its open condition, said vacuum extending into said pressure chamber when said vacuum vent is in its closed condition.

13. The fluid nozzle of claim 12, wherein said segregated fluid channel comprises a fluid flow limiting cross-sectional portion, said cross-sectional portion restricting the flow of fluid through said segregated fluid channel.

14. The fluid nozzle of claim 13, wherein said segregated fluid channel cross-sectional portion is positioned in said first poppet valve.

15. The fluid nozzle of claim 12, wherein said second fluid path accommodates fluid flow at a pressure greater than 50 p.s.i.

16. The fluid nozzle of claim 12, further comprising a central body, said central body comprising said downstream portion of said segregated flow channel.

17. The fluid nozzle of claim 16, wherein said Venturi port communicates with said segregated fluid channel in said central body.

18. The fluid nozzle of claim 16, further comprising a radial arm, said radial arm extending from said central body to said outer body, said radial arm comprising a channel there through, said first vacuum channel comprising said radial arm channel.

19. The fluid nozzle of claim 12, further comprising a second poppet valve, said second poppet valve being interchangeable with said first poppet valve in said nozzle, only one of said two or more interchangeable poppet valves comprising said downstream portion of said segregated flow channel, said second poppet valve downstream portion being shaped and sized to allow a greater fluid flow there through than the fluid flow allowed through said first poppet valve downstream portion.

20. The fluid nozzle of claim 12, further comprising a hollow conduit, said conduit communicating with said outlet of said segregated fluid channel to extend at least a portion of said segregated fluid channel through said conduit.

21. The fluid nozzle of claim 12, further comprising a spout vent, said spout vent communicating with and extending a desired length away from said vacuum vent.

22. The fluid nozzle of claim 12, further comprising a nozzle assembly and a spout assembly, said spout assembly comprising said first poppet valve said vacuum vent and said segregated fluid channel; said spout assembly being separable from said nozzle assembly.

23. The fluid nozzle of claim 12, wherein said segregated fluid channel comprises at least in part a groove, a slot or a tube.

* * * * *